US012600536B2

(12) United States Patent
Gnesin et al.

(10) Patent No.: US 12,600,536 B2
(45) Date of Patent: Apr. 14, 2026

(54) DUAL FUNCTION LID FOR MUG OR OTHER DRINKWARE

(71) Applicant: Personalizations, Inc., Tustin, CA (US)

(72) Inventors: Trevor Gnesin, Irvine, CA (US); Ken Homma, Pasadena, CA (US); Marjorie Wheeler, Torrance, CA (US)

(73) Assignee: Personalizations, Inc., Tustin, CA (US)

( * ) Notice: Subject to any disclaimer, the term of this patent is extended or adjusted under 35 U.S.C. 154(b) by 165 days.

(21) Appl. No.: 18/525,822

(22) Filed: Nov. 30, 2023

(65) Prior Publication Data

US 2025/0178800 A1 Jun. 5, 2025

(51) Int. Cl.

| | |
|---|---|
| ***B65D 47/06*** | (2006.01) |
| ***A47G 19/22*** | (2006.01) |
| ***B65D 47/08*** | (2006.01) |

(52) U.S. Cl.

CPC ..... *B65D 47/065* (2013.01); *A47G 19/2266* (2013.01); *B65D 47/0804* (2013.01); *B65D 2543/00046* (2013.01); *B65D 2543/00092* (2013.01)

(58) Field of Classification Search

CPC ..... B65D 47/065; B65D 47/0804; B65D 2543/00046; B65D 2543/00092; B65D 47/0857; B65D 81/3865; B65D 47/305; A47G 19/2266; A47G 19/2272

USPC ..... 220/254.2, 713, 717; 215/387

See application file for complete search history.

(56) References Cited

U.S. PATENT DOCUMENTS

| | | | | |
|---|---|---|---|---|
| 3,851,805 | A * | 12/1974 | Hazard | B65D 47/305 222/536 |
| 3,967,764 | A * | 7/1976 | Hazard | B65D 47/305 222/536 |
| 4,081,113 | A * | 3/1978 | Hazard | B65D 47/305 222/536 |
| 7,721,911 | B2 | 5/2010 | Chou | |
| 8,672,174 | B1 | 3/2014 | McMullin | |
| 10,159,368 | B2 | 12/2018 | Lin | |
| 10,486,868 | B2 | 11/2019 | Spivey et al. | |
| 10,512,347 | B1 | 12/2019 | Shepard et al. | |
| 11,589,695 | B2 * | 2/2023 | Spivey | B65D 81/3872 |
| 11,717,101 | B1 * | 8/2023 | Gui | B65D 47/065 220/711 |
| 2015/0173539 | A1 | 6/2015 | Mason | |
| 2017/0253396 | A1 | 9/2017 | Coon et al. | |
| 2018/0332987 | A1 * | 11/2018 | Lin | B65D 47/305 |
| 2021/0086960 | A1 * | 3/2021 | Wang | B65D 25/46 |
| 2022/0211197 | A1 | 7/2022 | Spivey et al. | |
| 2022/0402663 | A1 * | 12/2022 | Swartz | B65D 47/065 |

FOREIGN PATENT DOCUMENTS

| | | | |
|---|---|---|---|
| EP | 2754620 | B1 | 3/2016 |
| EP | 2928780 | B1 | 11/2016 |

* cited by examiner

*Primary Examiner* — Don M Anderson
*Assistant Examiner* — John Martin Hoppmann
(74) *Attorney, Agent, or Firm* — Larry K. Roberts

(57) ABSTRACT

Embodiments of a multifunction lid and drink container are described. The lid includes a sipping drink opening and a drink spout. The lid is configured to allow the user holding the drink container in one hand to drink from either the spout or the drink opening without rotating the lid body or changing hands holding the drink container.

18 Claims, 7 Drawing Sheets

DUAL FUNCTION LID FOR MUG OR OTHER DRINKWARE

BACKGROUND

Drinkware such as travel mugs, cups and other receptacles typically have a lid with a sealable opening through which the user may drink the beverage held in the receptacle. Some lids even provide two different types of openings through which the beverage may be consumed, for example a sipper hole and a sipper straw. The existing lid designs which employ a sipper hole and a sipper straw have required the user to turn the mug, changing the hand that holds the mug, to reverse the opening through which the beverage is consumed. This can be problematic, e.g. when the other hand is holding something else.

It would be a benefit to have a mug lid which allows the user to change from one sipper opening to another without changing hands or turning the mug.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1:
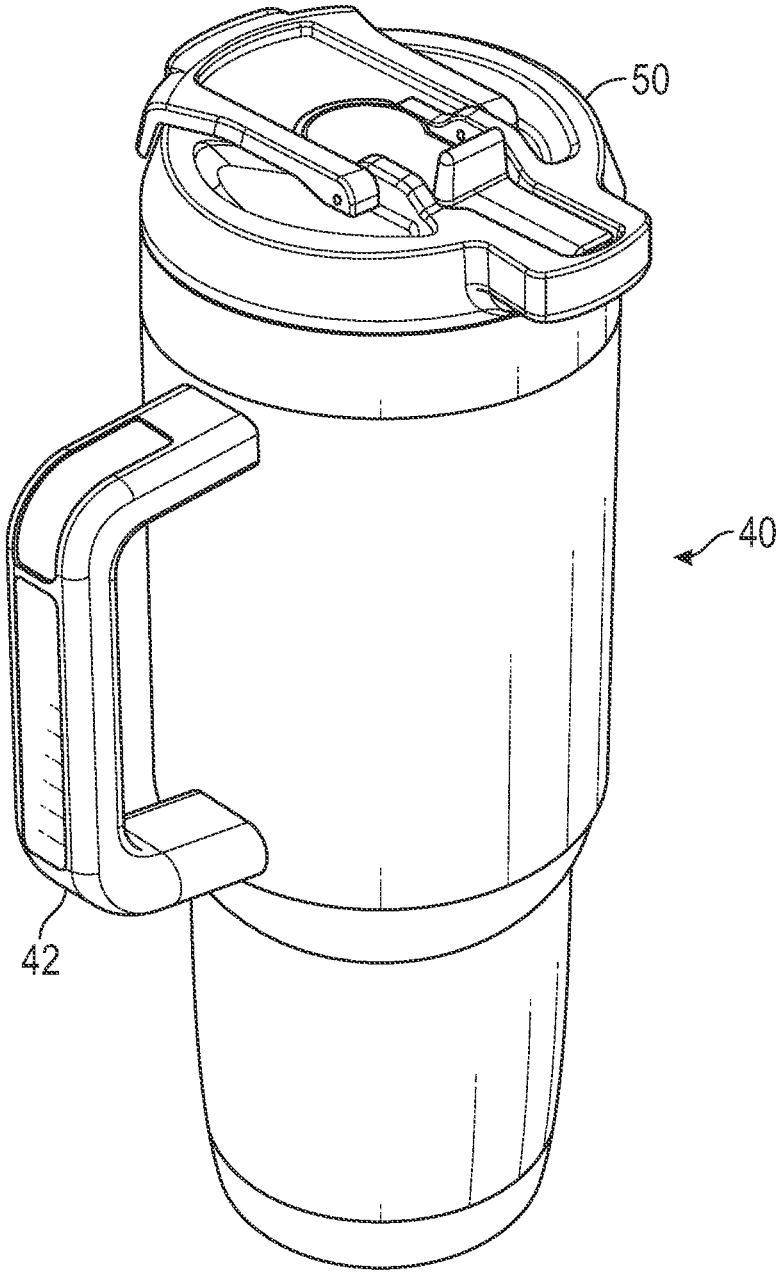
FIG. 1 is an isometric view of a travel mug with a dual function lid in accordance with aspects of the invention.

In the following detailed description and in the several figures of the drawing, like elements are identified with like reference numerals. The figures may not be to scale, and relative feature sizes may be exaggerated for illustrative purposes.

FIG. 1 illustrates an exemplary embodiment of a travel mug 40 with a dual function lid 50 in accordance with aspects of the invention. The mug has a handle 42 for convenient handling by the user. The mug 40 is an example of a drink container which may utilize the dual function lid

50. The container has a circular opening with interior threads for engaging corresponding threads on the lid 50.

The lid 50 is illustrated in further detail in FIGS. 2A-4D. The lid 50 includes a lid body 52 which has a circumferential thread 52A formed on the periphery of cylindrical portion 52B. The lid body is formed of a rigid plastic material in an exemplary embodiment. The diameter of the cylindrical portion 52B as well as the thread 52A are sized to mate with the mug 40 so that no leaks occur at the interface between the mug 40 and the lid 50. A silicone gasket (not shown in FIG. 1) ensures the interface seal is leak-proof.

Figure 2A:
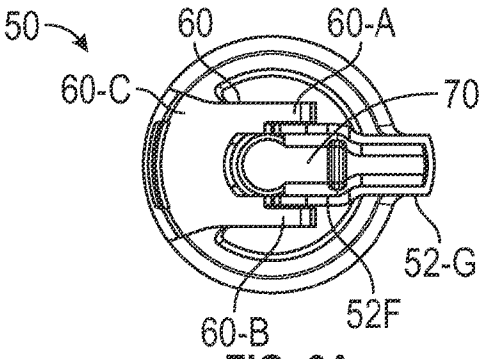
FIG. 2A is a top view of the dual function lid with the flap and spout in the closed positions.
Figure 2D:
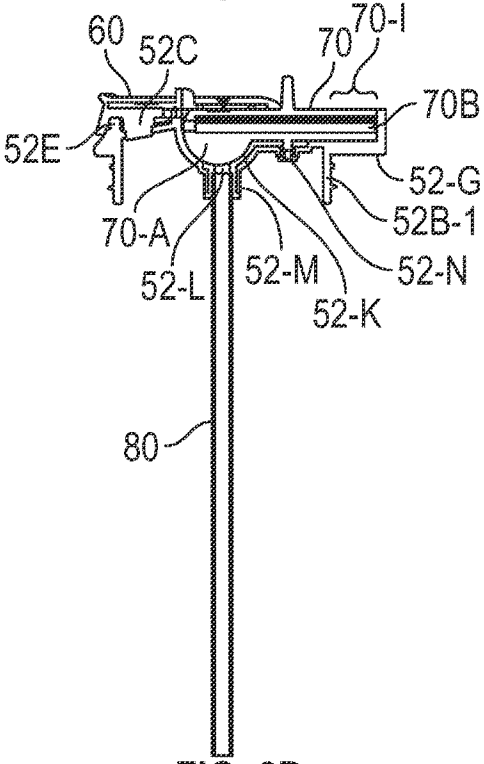
FIG. 2D is a cutaway view of the lid of FIG. 2A.
Figure 2C:
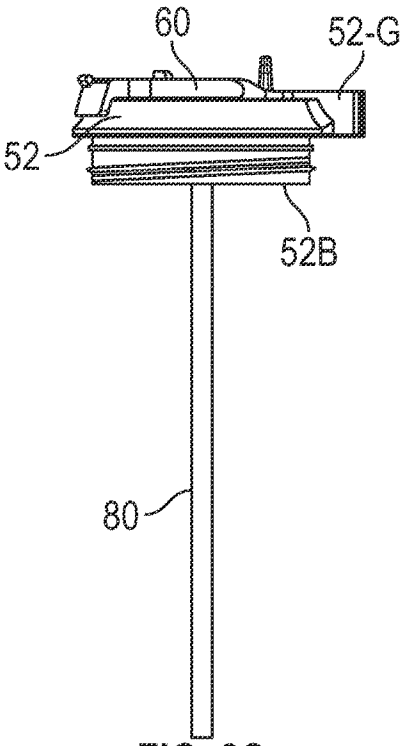
FIG. 2C is a front view of the lid of FIG. 2A.
Figure 2B:
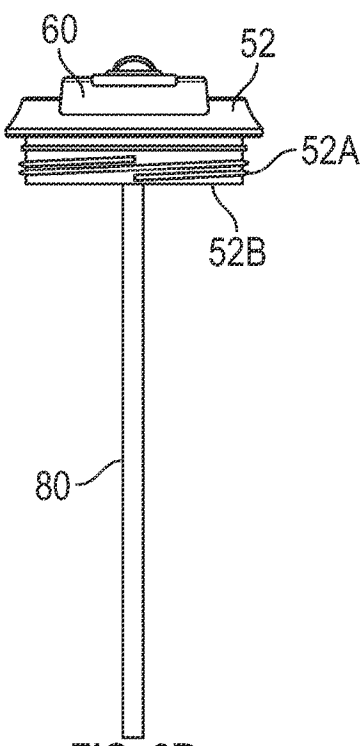
FIG. 2B is a left side view of the lid of FIG. 2A.
Figure 3A:
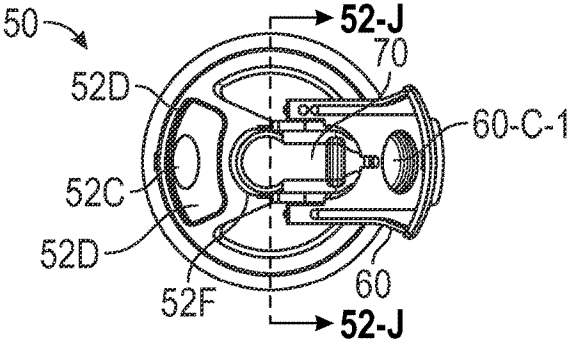
FIG. 3A is a top view of the dual function lid with the flap in the open position and the spout in the closed position.
Figure 3D:
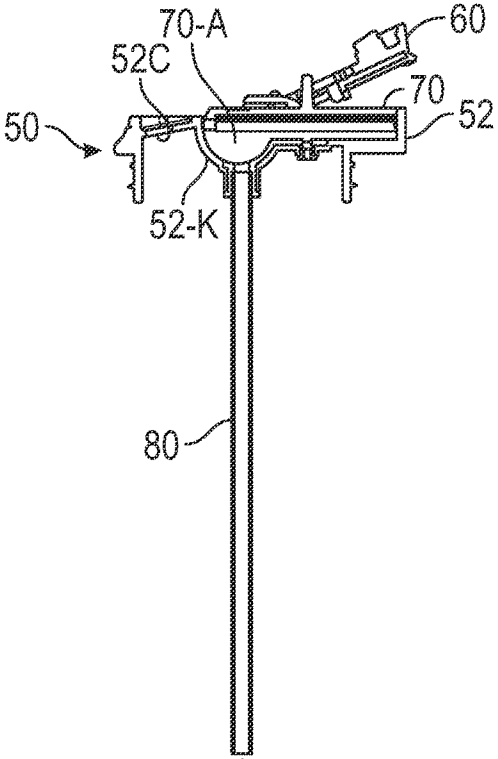
FIG. 3D is a cutaway view of the lid of FIG. 3A.
Figure 3C:
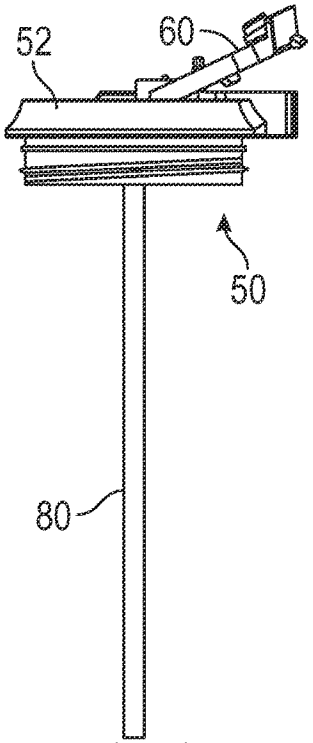
FIG. 3C is a front view of the lid of FIG. 3A.
Figure 3B:
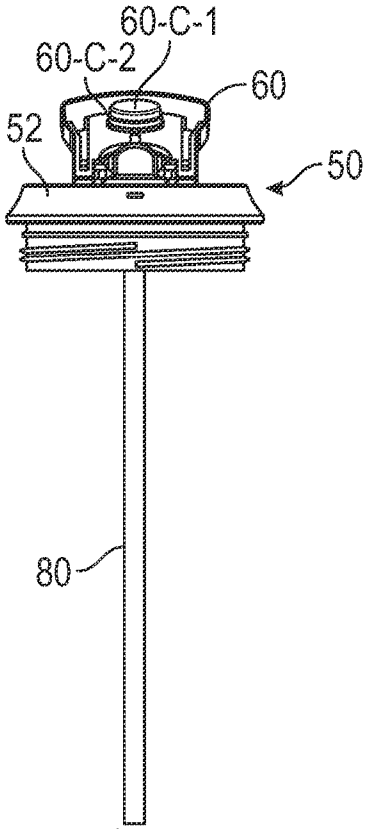
FIG. 3B is a left side view of the lid of FIG. 3A.

The lid body has an opening 52C formed in a lid recessed region 52D formed therein adjacent a peripheral edge 52E of the body 52 (see FIG. 2D). The opening 52C allows the user to drink fluid through the opening when pivotable flap 60 is in the open position illustrated in FIGS. 3A-3D. A vent hole 52-N is formed in the lid body, which is sealed by a plug 70-E protruding from the spout 70 (FIG. 2D) when the spout is in the closed position. When the spout 70 is in the open position and liquid is withdrawn through the spout, the vent hole 52-N allows air to replace the withdrawn liquid volume.

The lid 50 includes the pivotally mounted flap 60 and pivotable spout 70, each mounted for pivotal movement on the lid body 52. In this exemplary embodiment, the lid body 52 includes a body extension portion 52G which extends outside the periphery of the cylindrical portion 52B at perimeter 52B-1, such that the body extension portion extends outside the circular exterior perimeter of the lid body. The lid body 52 in this exemplary embodiment further includes a wall portion 52F (FIGS. 2A and 3A) extending around recess region 52H (FIG. 4A) and the outer periphery of the body extension portion 52G. The body extension portion 52G is cantilevered over the peripheral edge 52E of the lid body 52 and the cylindrical portion 52B.

The body extension portion 52G and the recess region 52H allow the spout 70 to have an elongated length and fit into the recess region 52H. The elongation distance 70-1 is shown in FIG. 2D, and exceeds the length that would be available if there were no body extension portion; i.e. the recess region would be shortened if it ended at the edge of the circular circumference of the lid 50. The body extension portion extends outside the external periphery of the drink container as shown in FIG. 1.

In other embodiments, the body extension portion 52G may be omitted as unnecessary. The diameter of the drinking vessel and lid may be sufficient large enough that the spout does not extend further beyond the external perimeter of the lid, or the spout may not be elongated so that the body extension portion 52G is unnecessary. In other embodiments, the recess region 52H may be omitted as well.

The flap 60 includes arm portions 60-A and 60-B which extend forward of main flap portion 60-C and outside portions of the wall portion 52F of the lid body. Pins 60-D (FIG. 4D) pass through openings in distal ends of the arm portions 60-A and 60-B and into openings in the wall portion 52F along axis 52-1 (FIG. 4A), and serve as pivot connections, allowing the flap to pivot about axis 52-1.

The main flap portion 60-C has a boss or seal plug 60-C-1 projecting from the underside of the flap portion 60-C, with a gasket 60-C-2 positioned over the boss. The boss 60-C-1 and gasket 60-C-2 are sized to fit into the opening 52C of the lid body and seal the opening against liquid leakage when the flap 60 is in the closed position.

Now consider the spout 70. The spout is a rigid structure, formed of an injection-molded plastic in an exemplary embodiment. The spout structure is configured to rotate about a pivot axis 52-J (FIG. 3A), on diametrically opposed projections 70-G extending outwardly from the pivot portion 70-A, which in this embodiment is a partial spherical portion, and received within channels or openings 70-H (FIG. 4A) defined within the wall portion 52F. The spout pivot axis 52-J is parallel to the flap pivot axis 52-1 in this exemplary embodiment.

In this exemplary embodiment, the spout 70 includes an elongated spout portion 70-B extending from the pivot portion 70-A and having a length to fit within the recess 52-H and the body extension portion 52-G. The spout 70 also has an opening 70-D formed through the elongated spout portion 70-B and through the pivot portion 70-A. The spout has a protruding plug portion 70-E which is configured to close the vent hole 52-N as described above with the spout in a closed position. A projecting boss 70-F extends transversely to the elongated spout portion 70-B and provides a tactile point for the user to exert force to rotate the spout 70 to the open position.

The lid body 52 is formed with a relieved region defined by a wall portion 52-K, which in this embodiment has a partial spherical configuration. The pivot portion 70-A of the spout 70 is fitted into the relieved region defined by wall portion 52-K. An opening 52-L is formed at the bottom of the relieved region and extends through the lid body. The opening 52-L is surrounded by a cylindrical wall 52-M to form a receptacle which is sized to receive the straw 80 as shown in FIG. 2D, for example, in an interference fit. In other embodiments, the straw 80 may be secured to the lid by adhesive or welding. In other embodiments, the cylindrical wall need not be integrally formed as part of the lid structure, but may be part of a separate structure.

The relieved region defined by the wall portion 52-K and the cylindrical wall 52-M are oriented to be centrally located within the peripheral edge of the lid body, in this exemplary embodiment. The opening 52-L is positioned centrally on the lid body 52. In other embodiments, the spout opening can be located off-center and closer to the edge of the lid and the drinkware vessel opening.

The spout 70 is configured for rotation about axis 52-J from the closed position shown in FIGS. 2A-3D to the open position shown in FIGS. 4A-4D. In the open position, the spout is rotated over-center more than 90 degrees, in this exemplary embodiment about 102 degrees. In other embodiments, the spout is rotated upwardly at any angle of 85 degrees or more, that allows the user to drink through the spout from the same side as the opening 52C. In this position the opening 70-D is aligned with opening 52-L, so that the spout 70 is an extension of the straw 80. The user can draw on the spout 70 in the open position to drink from the mug 40. The flap 60 is positioned in the closed position with the spout 70 in the open position.

In an exemplary embodiment, the spout structure 70A closes the opening 52-L and provides leak protection when the spout is in the closed position as illustrated in FIG. 2D. Other embodiments may not provide full sealing.

Figure 4A:
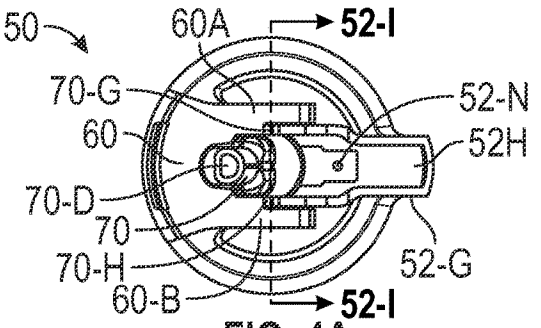
FIG. 4A is a top view of the dual function lid with the flap in the closed position and the spout in the open position.
Figure 4D:
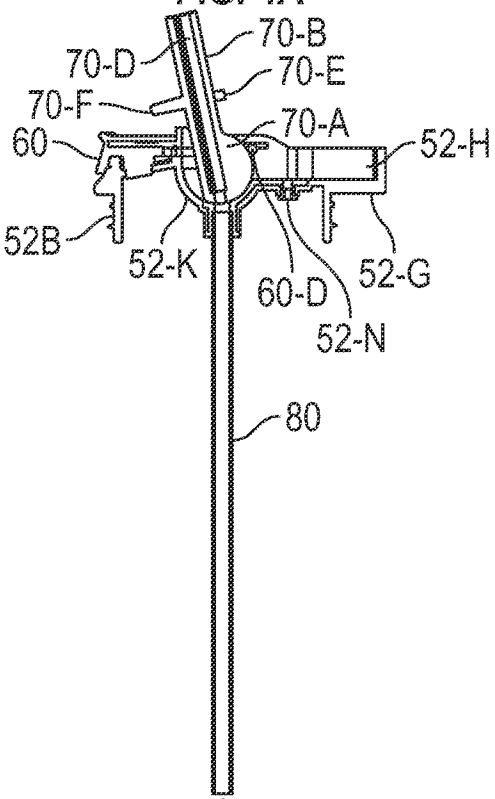
FIG. 4D is a cutaway view of the lid of FIG. 4A.
Figure 4C:
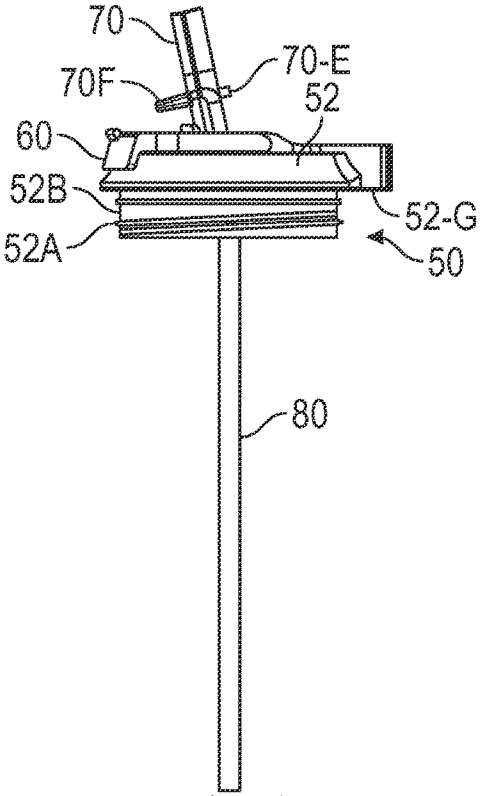
FIG. 4C is a front view of the lid of FIG. 4A.
Figure 4B:
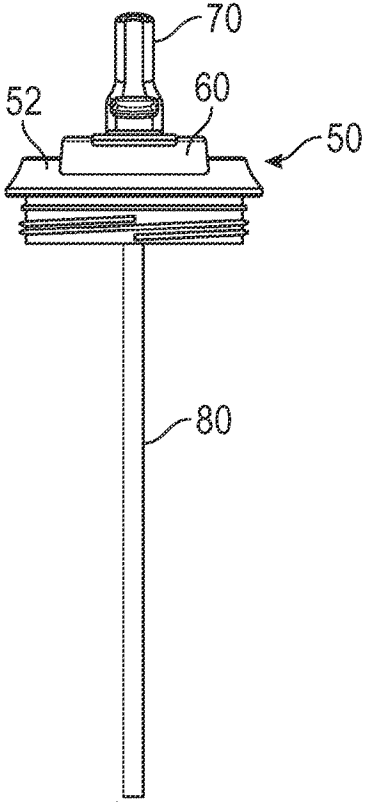
FIG. 4B is a left side view of the lid of FIG. 4A.

In the exemplary embodiment of FIGS. 2A-4C, the respective rotations of the flap 60 and the spout 70 from the respective closed and open positions are in opposite directions. In FIG. 3C, the flap 60 has been rotated clockwise from the closed to the open position, with the spout remaining in the closed position. In FIG. 4C, the spout has been rotated counterclockwise from the closed to the open position, with the flap remaining in the closed position.

Figure 5:
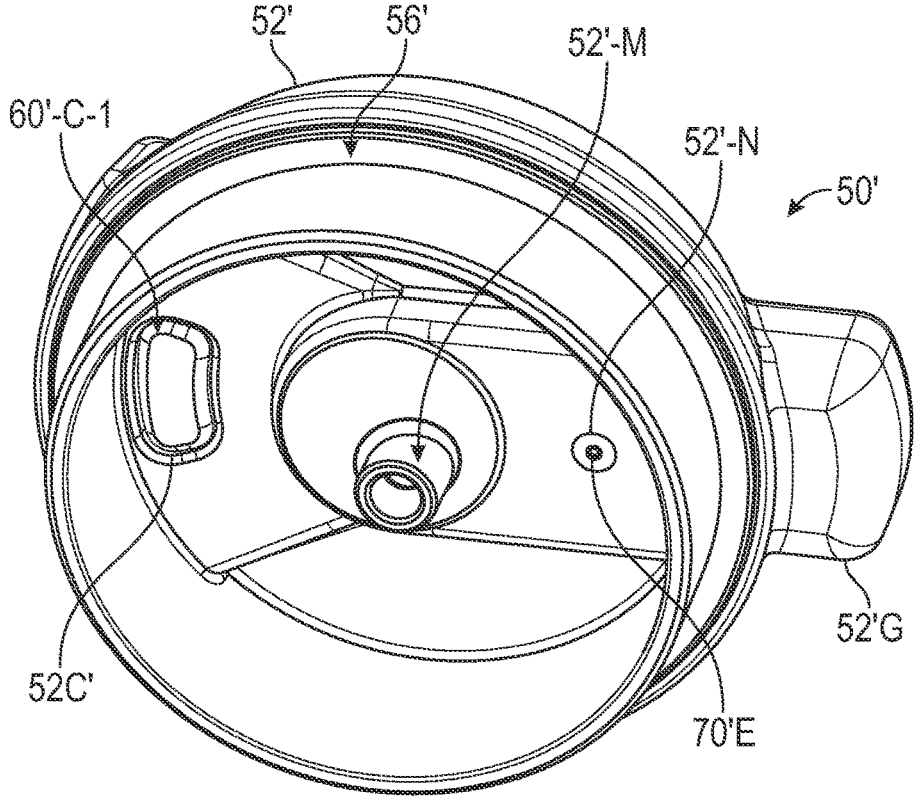
FIG. 5 is an isometric lower view of another embodiment of a lid in accordance with aspects of the invention.

FIG. 5 is an isometric lower view of an embodiment of a lid 50' in accordance with aspects of the invention. The flap and spout are in the closed positions. The lid 50' has a silicone gasket 56' which is configured to seal against the mug top rim when the lid is threaded onto the mug. For simplicity, the threads are not shown in FIG. 5. The opening 52C' is closed by seal plug 60'-C-1 on flap 60'. The vent hole 52'-N is closed by plug 70'-E of the spout 70'. The lid 50' also includes the straw receptacle 52'-N.

Figure 6:
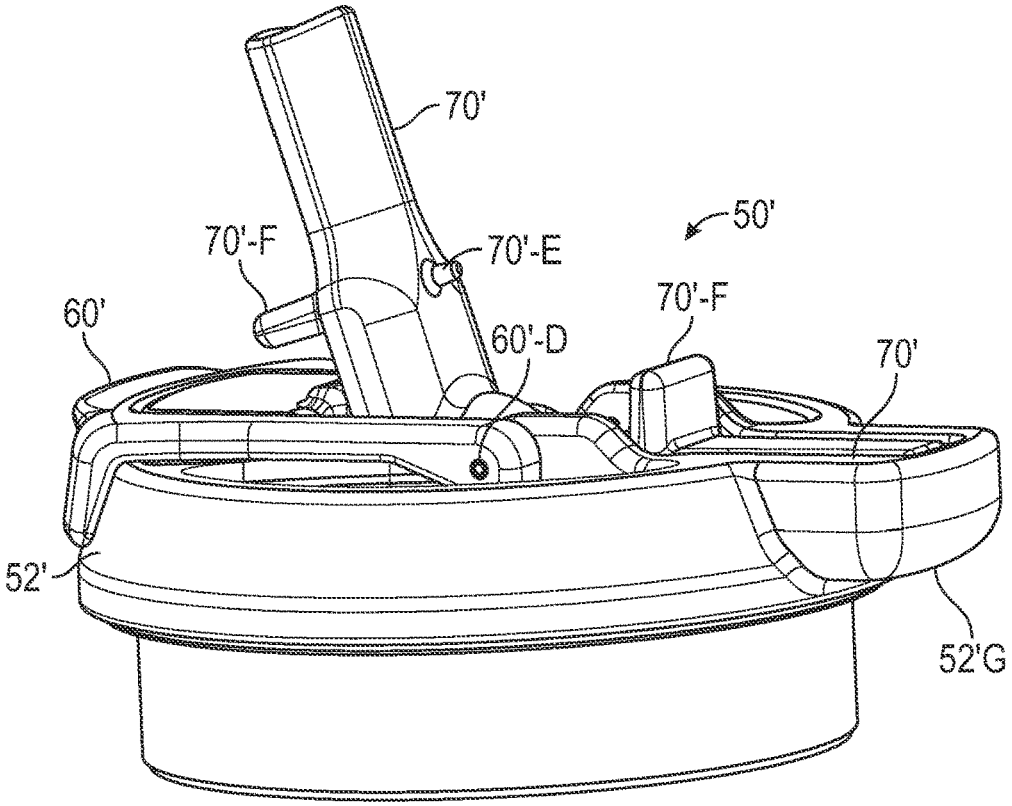
FIG. 6 is an isometric side view of the lid of FIG. 5, showing the spout in both the open and closed positions.

FIG. 6 is an isometric side view of the lid 50' showing the spout in both the open and closed positions.

Figure 7:
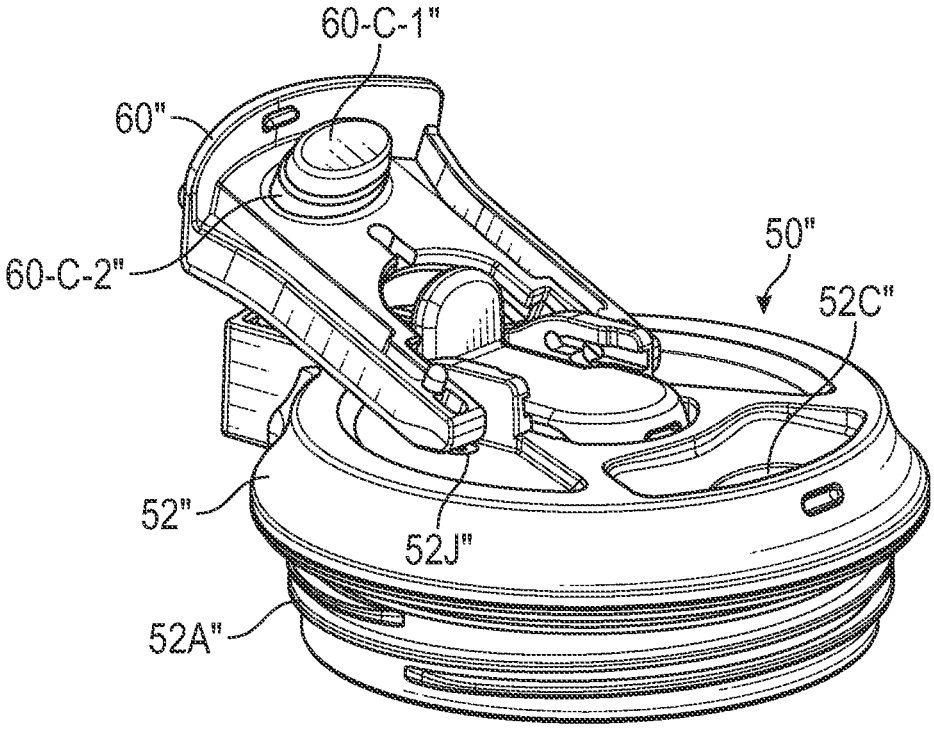
FIG. 7 is an isometric view of another alternate embodiment of a dual function lid with the flap in the open position and the spout in the closed position.
Figure 8:
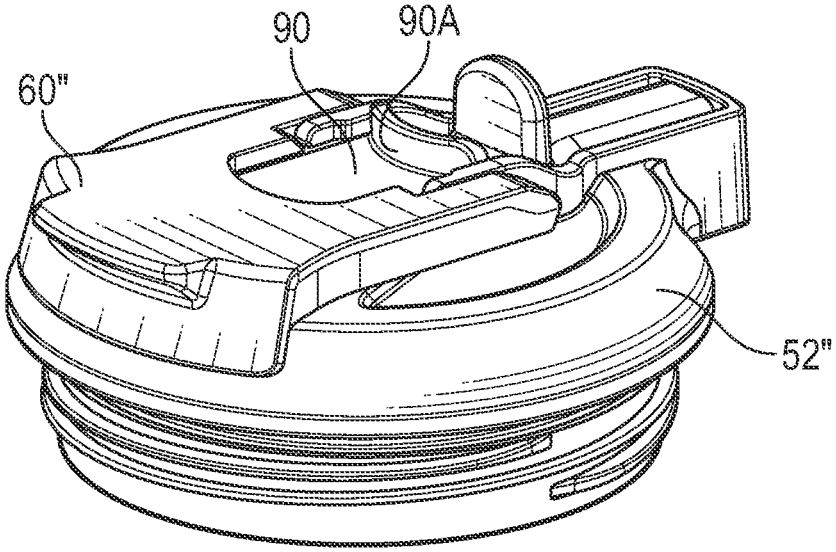
FIG. 8 is an isometric view of the lid of FIG. 7, with the flap in the closed position, and a lock structure in the locked position.
Figure 9:
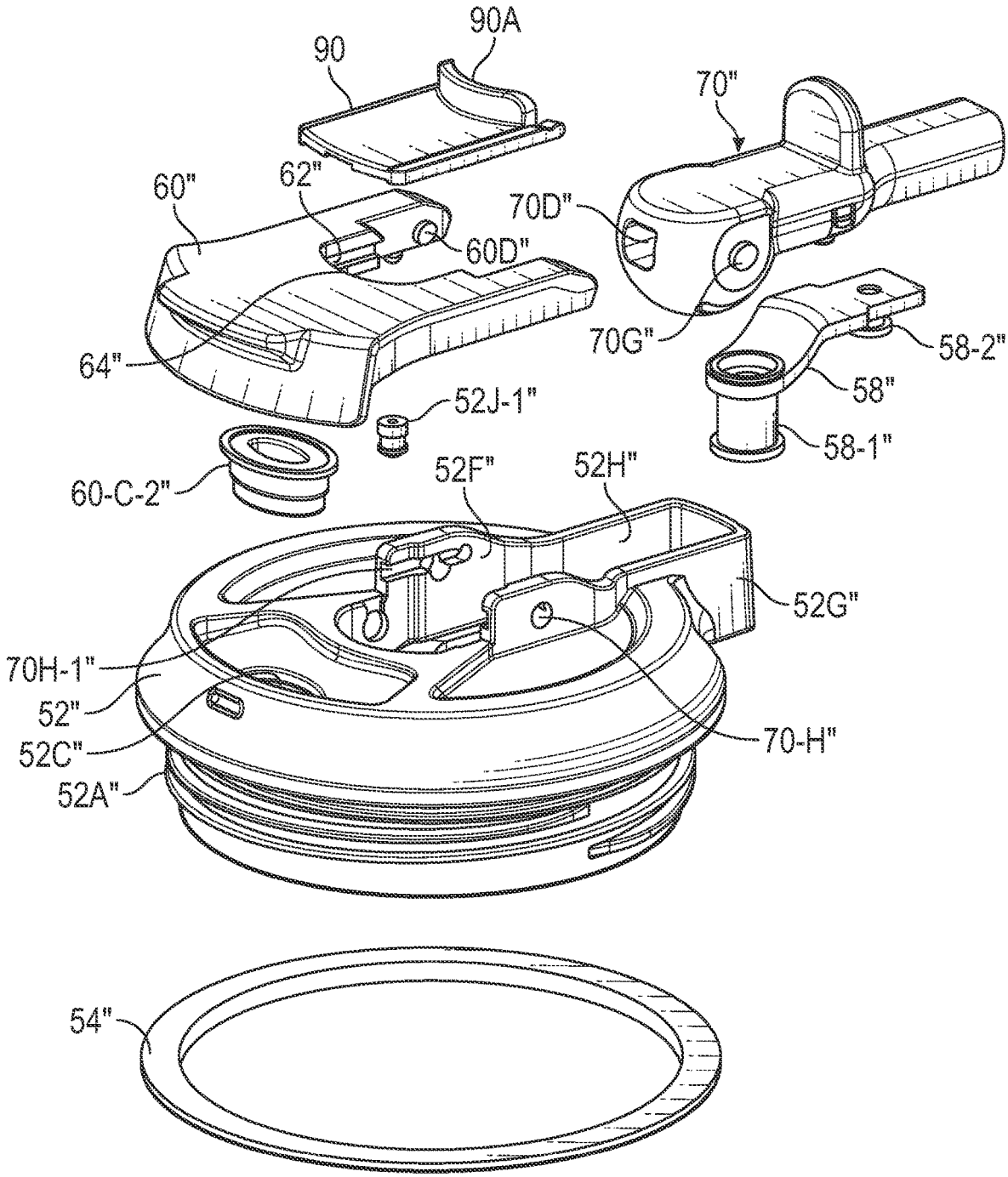
FIG. 9 is an exploded isometric view of the lid of FIG. 7.

FIGS. 7, 8 and 9 illustrate a further exemplary embodiment of a lid 50" incorporating aspects of the invention. The lid 50" includes a sliding lock panel 90 with an upright stop surface 90A. The panel 90 in this exemplary embodiment includes a generally planar portion, and is configured to slide within channels 62" formed in the arms of the flap 60" (FIG. 9).

In the unlocked position, the panel 90 is received within the channels 62" to position the stop surface 90A against the corresponding surface 64" of the flap. In this position, the user may open the flap 60" to drink from the sipper opening 52" with the panel 90 carried by the flap, or may lift the spout 70" to drink through the spout with the flap in the closed position.

In the locked position of the lock panel 90 (FIG. 8), the panel slides along the channels 62" into channels 70H-1" formed in wall portion 52F". In this position, the flap is prevented from opening by engagement of the panel in channels 70H-1", and the spout is prevented from opening by the panel constrained within the channels 62" and 70H-1"

In this exemplary embodiment, molded elastomeric structure 58" (FIG. 9) is flexible so as that the tubular portion 58-1" fits within the straw wall structure of the lid 52" and provide a liquid seal against the spout surface. The elastomeric structure 58" includes tubular structure 58-2" which serves fit into the air opening (not shown in FIG. 9) analogous to opening 52-N of the first lid embodiment.

The lid 52" includes elastomeric seal 60-C-2" fitted onto boss 60-C-1" to seal the opening 52C" with the flap 60" in the closed position (FIG. 8). The lid also includes elastomeric fitting 52J-1" which is position within an air hole formed in the lid, to allow to enter the drinking vessel as the user sips from the sipper opening 52C". The flap 60" seals against the fitting 52J-1" when in the closed position. FIG. 9 shows the elastomeric gasket 54" for sealing the interface to the drinking vessel.

In use, the lid 50, 50' or 50" is assembled to the drinking vessel by twisting the lid and its thread onto the drinking vessel and its corresponding thread. With the user holding the mug handle in one hand, the user may open the flap 60, 60' or 60" with the spout 70, 70' or 70" in the closed position, and drink from the contents of the vessel through the opening 52C, 52C' or 52C". Alternatively, and while still holding the mug with the same hand, the user could drink through the spout 70, 70' or 70" with the flap in the closed position and the spout rotated to the open position.

Although the foregoing has been a description and illustration of specific embodiments of the subject matter, various modifications and changes thereto can be made by persons skilled in the art without departing from the scope and spirit of the invention.

What is claimed is:

1. A multi-function lid for a drink container having a generally circular opening, the lid comprising:

a lid body including a generally cylindrical lid portion configured to connect into the circular opening of the drink container;

the lid body having a drink opening formed therein adjacent a peripheral edge of the lid body and configured to allow a user to drink from the drink opening;

a flap structure arranged for pivotal movement between a flap open position and a flap closed position, the flap structure including a seal plug portion configured to enter the drink opening with the flap structure in the closed position to seal the drink opening;

a rigid spout structure arranged for pivotal movement between a spout open position and a spout closed position, the spout structure including a spout portion and a pivot portion, the spout structure including a passageway extending through the spout structure and the pivot portion and having a drink port on one end of the passageway and an input port at a terminal end of the passageway at a surface of the pivot portion;

the lid body further including a region configured to receive the pivot portion of the spout structure in a pivotable connection, and a spout-connectable opening formed through the lid body;

wherein the spout structure is configured to align the input port with the spout-connectable opening with the spout structure in the spout open position, allowing the user to drink from the spout; and a slidable lock structure configured to selectively lock the flap and the spout in respective closed positions when the lock structure is positioned in a lock position, and when in an unlocked position to allow either the flap or the spout to be rotated to respective open position; and wherein the lid is configured to allow the user holding the drink container in one hand to drink from either the spout or the drink opening without rotating the lid body or changing hands holding the drink container.

2. The multifunction lid of claim 1, wherein the spout-connectable opening is centered within the cylindrical portion of the lid.

3. The multifunction lid of claim 1, wherein the pivotal movement of the flap structure is about a first pivot axis, the pivotal movement of the spout structure is about a second pivot axis, and wherein the first pivot axis is spaced from and parallel to the second pivot axis.

4. The multifunction lid of claim 1, wherein the respective pivotal movements of the flap structure and the spout structure from the respective closed and open positions are in opposite directions.

5. A multi-function lid for a drink container having a generally circular opening, the lid comprising:

a lid body including a generally cylindrical lid portion configured to connect into the circular opening of the drink container;

the lid body having a drink opening formed therein adjacent a peripheral edge of the lid body and configured to allow a user to drink from the drink opening;

a flap structure arranged for pivotal movement between a flap open position and a flap closed position, the flap structure including a seal plug portion configured to enter the drink opening with the flap structure in the closed position to seal the drink opening;

a rigid spout structure arranged for pivotal movement between a spout open position and a spout closed position, the spout structure including a spout portion and a pivot portion, the spout structure including a passageway extending through the spout structure and the pivot portion and having a drink port on one end of the passageway and an input port at a terminal end of the passageway at a surface of the pivot portion;

the lid body further including a region configured to receive the pivot portion of the spout structure in a pivotable connection, and a spout-connectable opening formed through the lid body;

wherein the spout structure is configured to align the input port with the spout-connectable opening with the spout structure in the spout open position, allowing the user to drink from the spout; and wherein the lid is configured to allow the user holding the drink container in one hand to drink from either the spout or the drink opening without rotating the lid body or changing hands holding the drink container, wherein:

the lid body further including a body extension portion which extends outside of and is cantilevered over the cylindrical portion; and the spout portion is configured to extend to and the drink port of the spout portion is be received in the body extension portion when in the closed position.

6. The multifunction lid of claim 5, wherein the drink opening is disposed on the peripheral edge opposite the body extension portion on the lid body.

7. The multifunction lid of claim 1, further comprising a straw receptacle on a drink-container-facing surface about the spout-connectable opening.

8. The multifunction lid of claim 1, wherein the spout is configured for rotation by at least 85 degrees from the closed position to the open position.

9. The multifunction lid of claim 1, wherein the flap comprises opposed arm portions with facing channels formed in the opposed arm portions, and the lock structure comprises a panel configured to slide within the facing channels between the lock and unlocked positions.

10. A drink container having a generally circular opening, in combination with the multifunction lid of claim 1.

11. A system, comprising:

a drink container having a generally circular opening;

a multi-function lid configured to engage the opening of the drink container, the multi-function lid comprising:

a lid body including a generally cylindrical lid portion configured to connect into the circular opening of the drink container;

the lid body having a drink opening formed therein adjacent a peripheral edge of the lid body and configured to allow a user to drink from the drink opening;

a flap structure arranged for pivotal movement between a flap open position and a flap closed position, the flap structure including a seal plug portion configured to enter the drink opening with the flap structure in the closed position to seal the drink opening;

a rigid spout structure arranged for pivotal movement between a spout open position and a spout closed position, the spout structure including an elongated spout portion and a pivot portion, the spout structure including an elongated passageway extending through the elongated spout structure and the pivot portion and having a drink port on one end of the elongated passageway and an input port at a terminal end of the elongated passageway at a surface of the pivot portion;

the lid body further including a relieved region defined by a wall portion and configured to receive the pivot portion of the spout structure in a pivotable connection, and a spout-connectable opening formed through the lid body and the wall portion;

the lid body further including a body extension portion which extends outside of and is cantilevered over the cylindrical portion, the body extension portion including a recess region;

the elongated spout portion extends to and is received in the recess region when in the closed position;

wherein the spout structure is configured to align the input port with the spout-connectable opening with the spout structure is in the spout open position, allowing the user to drink from the spout; and a lock structure configured to selectively lock the flap and the spout in respective closed positions when the lock structure is positioned in a lock position, and when in an unlocked position to allow either the flap or the spout to be rotated to respective open position; and wherein the lid is configured to allow the user holding the drink container in one hand to drink from either the spout or the drink opening without rotating the lid body or changing hands holding the drink container.

12. The system of claim 11, wherein the spout-connectable opening is centered within the cylindrical portion of the lid.

13. The system of claim 11, wherein the pivotal movement of the flap structure is about a first pivot axis, the pivotal movement of the spout structure is about a second pivot axis, and wherein the first pivot axis is spaced from and parallel to the second pivot axis.

14. The system of claim 13, wherein the respective pivotal movements of the flap structure and the spout structure from the respective closed and open positions are in opposite directions.

15. The system of claim 11, wherein the drink opening is disposed on the peripheral edge opposite the body extension portion on the lid body.

16. The system of claim 11, wherein a straw receptacle is formed in the lid body on a drink-container-facing surface about the spout-connectable opening.

17. The system of claim 16, further comprising a removable straw configured to fit into the straw receptacle.

18. The system of claim 11, wherein the spout is configured for rotation by at least 85 degrees from the closed position to the open position.

* * * * *